United States Patent [19]

Uhlin

[11] Patent Number: 4,929,927

[45] Date of Patent: May 29, 1990

[54] SURVEILLANCE INSTALLATION

[76] Inventor: Per A. Uhlin, Backen, Stensfält, 54500 Töreboda, Sweden

[21] Appl. No.: 50,000

[22] PCT Filed: Aug. 8, 1986

[86] PCT No.: PCT/SE86/00359

§ 371 Date: Apr. 20, 1987

§ 102(e) Date: Apr. 20, 1987

[87] PCT Pub. No.: WO87/01226

PCT Pub. Date: Feb. 26, 1987

[30] Foreign Application Priority Data

Aug. 19, 1985 [SE] Sweden ..... 8503863

[51] Int. Cl.[5] ..... G08B 13/08

[52] U.S. Cl. ..... 340/547; 340/550; 340/551

[58] Field of Search ..... 340/521, 541, 550, 551, 340/547, 693

[56] References Cited

U.S. PATENT DOCUMENTS

| | | | |
|---|---|---|---|
| 3,696,380 | 11/1972 | Murphy | 340/547 |
| 3,886,534 | 5/1975 | Rosen et al. | 340/574 |
| 4,092,643 | 5/1978 | Stolarczyk . | |
| 4,321,592 | 3/1982 | Crandall et al. . | |
| 4,367,459 | 1/1983 | Amir et al. | 340/541 |
| 4,418,336 | 11/1983 | Taylor | 340/571 |

FOREIGN PATENT DOCUMENTS

| | | |
|---|---|---|
| 0063876 | 11/1982 | European Pat. Off. . |
| 364791 | 3/1974 | Fed. Rep. of Germany . |
| 2335772 | 1/1975 | Fed. Rep. of Germany . |
| 2923732 | 1/1981 | Fed. Rep. of Germany . |
| 2080125 | 11/1971 | France . |

OTHER PUBLICATIONS

Banc, Burglar Alarm, 4-15-83, 4 pages.
Kitterman, Alarm Control System, 6-2-81, 7 pages.

*Primary Examiner*—Joseph A. Orsino
*Assistant Examiner*—Frank M. Scutch, III
*Attorney, Agent, or Firm*—Dennison, Meserole, Pollack & Scheiner

[57] ABSTRACT

A surveillance installation to protect an area of ground. A number of sensing units are spaced around the perimeter of the area to be protected. Each sensing unit comprises a network of strands inconspicuously deployed over a portion of the ground and connected to a magnetically operated switch. When an intruder trips one of the strands, the magnetic switch is operated to signal the presence of an intruder. A central monitoring unit powered by a low voltage D.C. supply connects the various sensing units by means of a two-wire circuit. The central monitoring unit includes signalling devices to indicate the location of the intruder. The system also has the capability of initiating intruder warning devices.

18 Claims, 7 Drawing Sheets

SURVEILLANCE INSTALLATION

BACKGROUND OF THE INVENTION

The present invention relates to a surveillance installation. In public places with a large through-flow of people TV cameras are generally used, connected to a surveillance centre where an observer sits and watches events. This is an efficient but extremely expensive method. For surveillance of areas where only a few people normally pass it is generally advisable to close off the area by means of a barrier or signs stating that entry is not permitted or is only permitted at certain times.

The present invention relates to an installation for surveillance of an area of the latter type. It is thus important that persons coming into contact with the installation are not in any way injured thereby. This is enabled by the invention by the provision of a manned or unmanned central unit which receives information if anyone is at the periphery of the area. The central unit is electrically connected to a number of sensing means located along the periphery of the area. Each sensing means is provided with one or more sensitive members which, when activated, alter the electrical state in the current circuit including the sensing means and said central unit. The sensitive member may constitute a wire, a net or the like which may either be placed on the surface of the ground or be suspended.

According to an advantageous embodiment the sensitive member is provided at one end with a magnet loosely applied on the sensing means and retained there by an attraction member which may consist of a strip of ferrometal. If the sensitive member is touched the magnet is easily dislodged and the electrical state in the above-mentioned current circuit is thus altered. Said magnet might, for instance, influence a circuit breaker or switch so that, in the absence of the magnet, a resistor is short-circuited.

It should be evident that the magnetic force of the magnet at the sensing means can be controlled by varying the distance between the magnet and the unit in the sensing means to which the magnet is attracted.

Electric current is transmitted between the central unit and a sensing means through a two-way wire. Both direct and alternating current are suitable for the purpose.

According to an advantageous embodiment of the present invention the installation can also be used to initiate action members of various types. Such action members may consist of a tape-recorder providing information as to the cause of the trespassing. Other examples of action members are search-lights or a unit emitting a smoke screen. For military applications the action member may consist of a mine or a unit emitting toxic gas.

To enable the installation to be used for both gathering information and taking action it is advisable to use two different direct voltages. The same wire connections used for the sensing means can then also be used for the action members. Each sensing means, and possibly also the central unit, should include a rectifier. This enables the two direct voltages to be pole-inverted with respect to each other, one direct voltage only cooperating with the sensing member and the other direct voltage only cooperating with the action member.

The two direct voltages may have the same or different values. In some cases it has proven advisable for one voltage to have a low value and the other a high value.

Further characteristics of the present invention are revealed in the following claims.

The present invention will be described in more detail with reference to the accompanying drawings showing one embodiment thereof.

BRIEF DESCRIPTION OF THE DRAWINGS

FIG. 1 shows an alarm and control centre 1 connected to a distribution unit 2. A sensing means and an action member, to be described in more detail in the following, can be connected to the distribution unit. The distribution unit 2 is connected to the alarm and control centre 1 by two leads. One of these leads includes a circuit with a light-emitting diode 9A, two rectifiers 23A and 24A, a resistor 21A and a three-way switch 15A. A buzzer 10 can also be connected in parallel to this circuit. One or other of two direct voltage sources 11 and 12 can be connected to the two leads by means of circuit breakers 17, 18 and 19. The distribution unit 2 is provided with three connections, namely two outer connections and one intermediate connection. The two outer connections are joined together by a rectifier 16. The intermediate connection is connected to one of the two wires to the alarm and control centre, and the other wire from the alarm and control centre 1 is connected to one of the outer connections. A sensing means is connected to the intermediate connection and one of the outer connections and an action member is connected to the other outer connection and the intermediate connection.

A number of distribution units 2 are connected to the central alarm and control unit 1, each distribution unit having its own circuit consisting of the units 9, 15, 21, 23 and 24.

Figure 1:
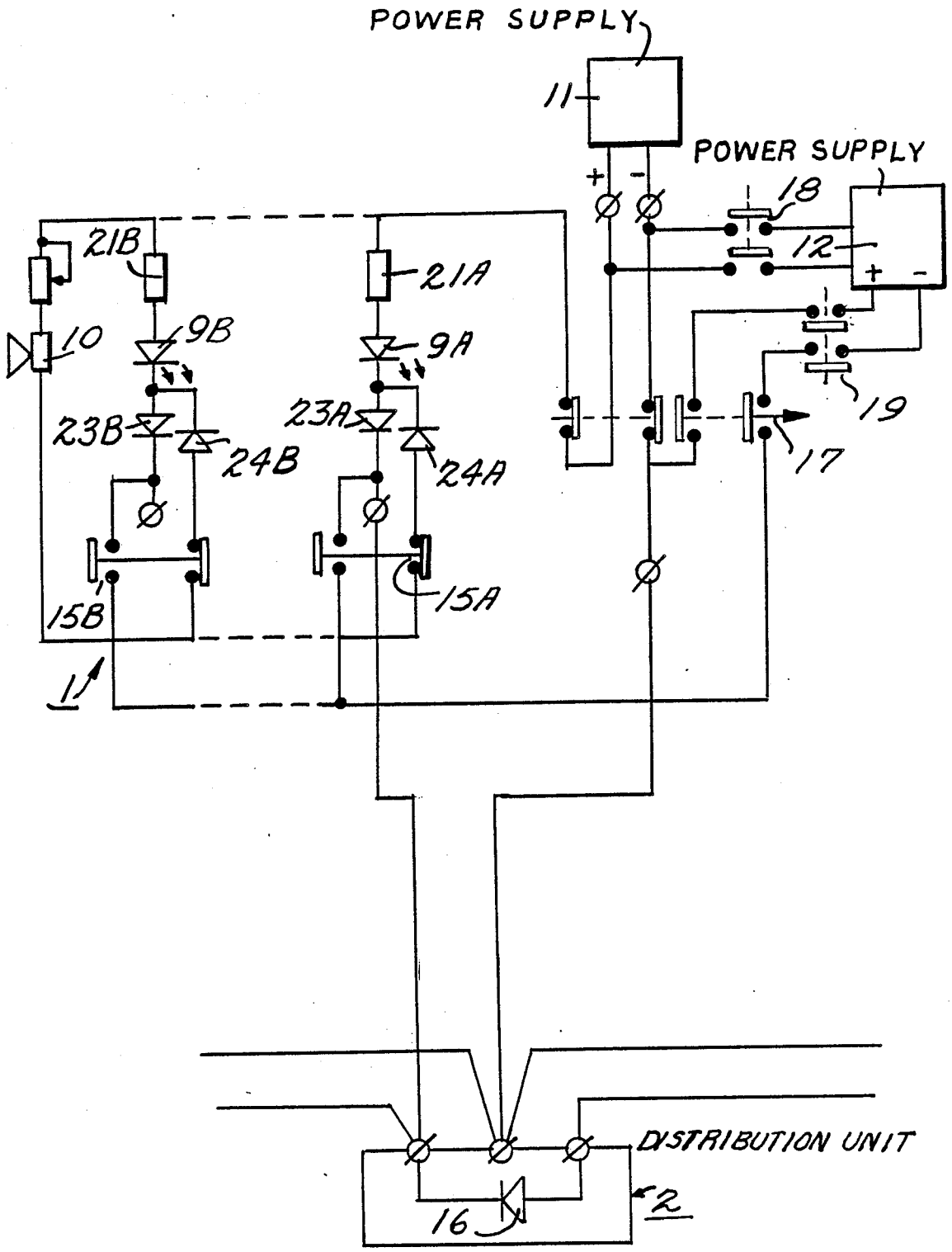
FIG. 1 is a wiring diagram for an alarm and control centre with a distribution unit.
Figure 2:
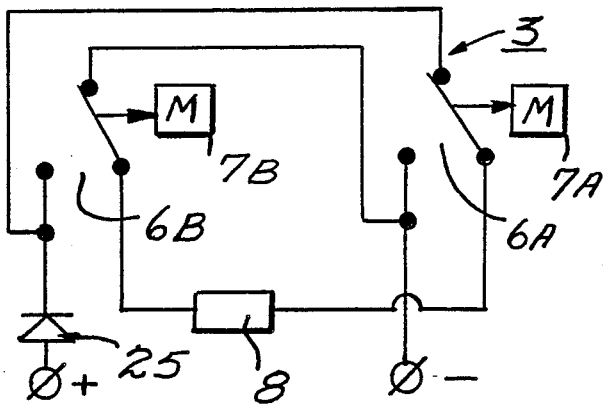
FIG. 2 is a wiring diagram for a non-activated sensing means.
Figure 4:
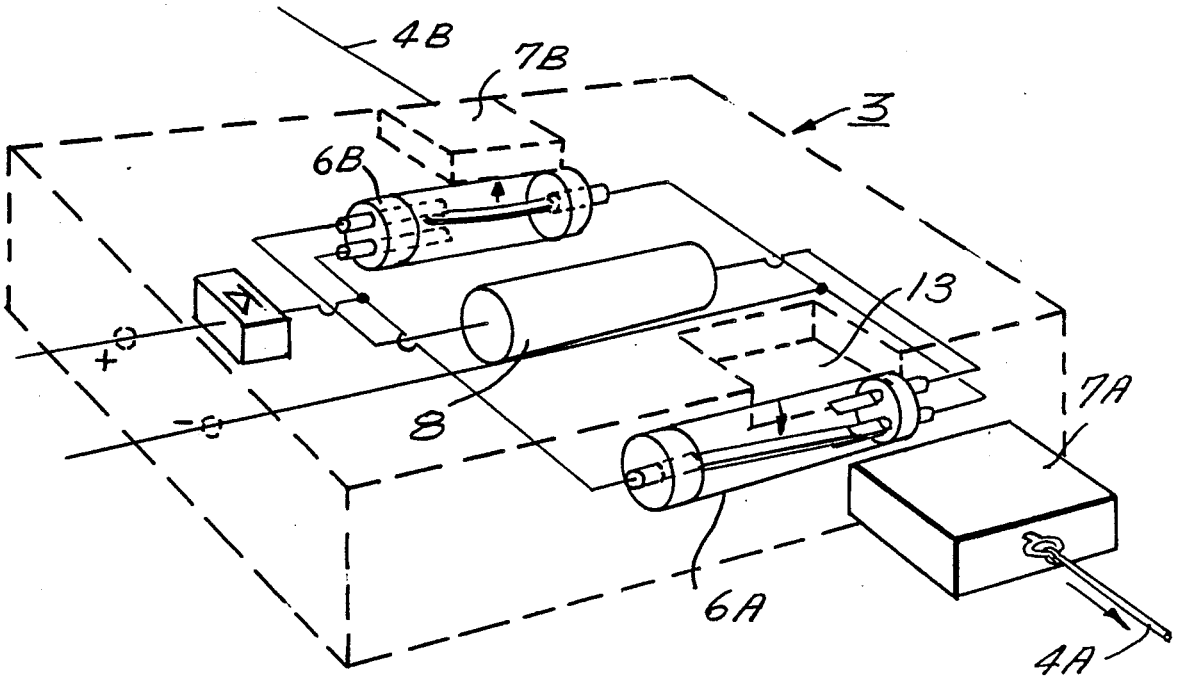
FIG. 4 is a see-through view of an embodiment of a sensing means.

FIG. 2 shows a wiring circuit for a sensing means containing two switches 6A and 6B. The switches are actuated by magnets 7A and 7B, respectively, and each switch is enclosed in a protective gas tube. The two switches are used to short-circuit a resistor 8. A practical embodiment of a sensing means is shown in FIG. 4 revealing two pockets for the magnets 7A and 7B, the pocket for magnet 7A being designated 13. The pocket is located above the switch 6A which the magnet is to actuate. Below each magnet is a ferrometallic unit which attracts the magnets 7A and 7B. When a magnet is in place in its pocket, the contact tongue assumes the position shown to the left in FIG. 4 and, in the absence of the magnet, the position shown for the righthand switch.

Figure 3:
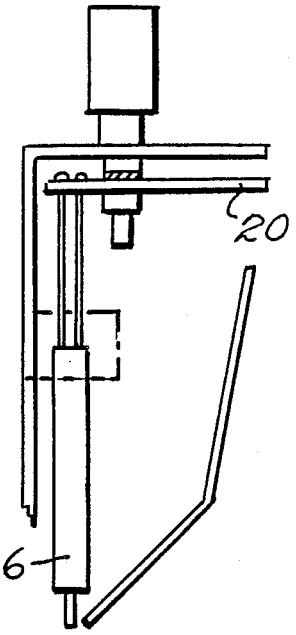
FIG. 3 is a section of a sensing means.

FIG. 3 shows an embodiment of a switch with associated magnet. The force with which a magnet is retained in the sensing means can be controlled by making the ferrometallic strip adjustable in relation to a magnet placed in the pocket.

In a sensing means of the type just described, each magnet may have an eye connected to a cord or net, both cord and net being either suspended or placed loose on the ground, preferably in such a manner as to be difficult to detect. The magnetic force shall be sufficient to remove the magnet without the person coming into contact with the cord or net being aware that he has encountered an obstruction.

FIGS. 5–8 describe a chain of events from alarm to action for an installation comprising a distribution unit 2, a sensing means 3 and an action member 5. An installation comprising a larger number of sensing means and action members would function in exactly the same manner. The relevant current circuits have been indicated in thicker lines in the drawings.

Figure 5:
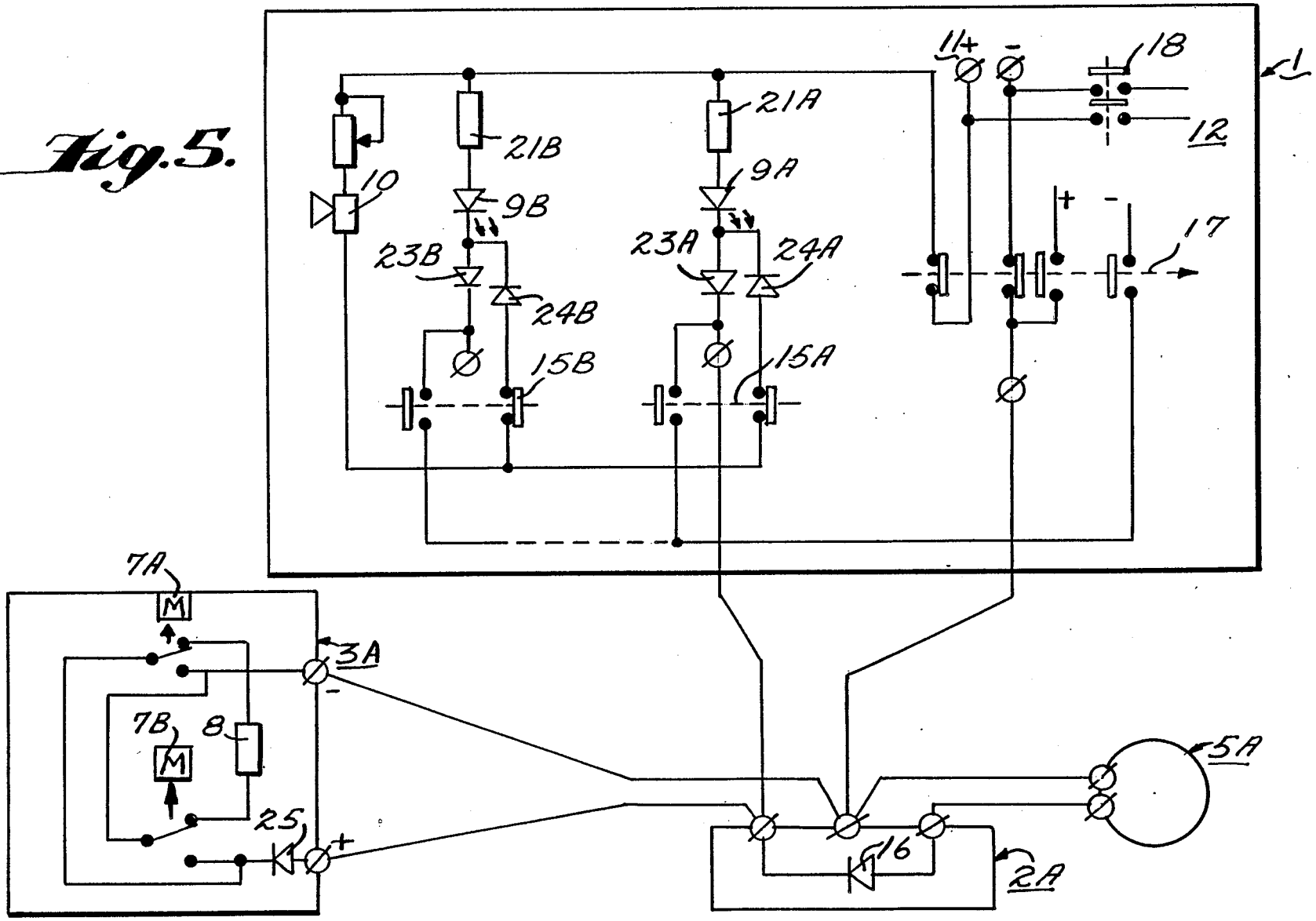
FIG. 5 is a wiring diagram for an installation in non-activated state.
Figure 6:
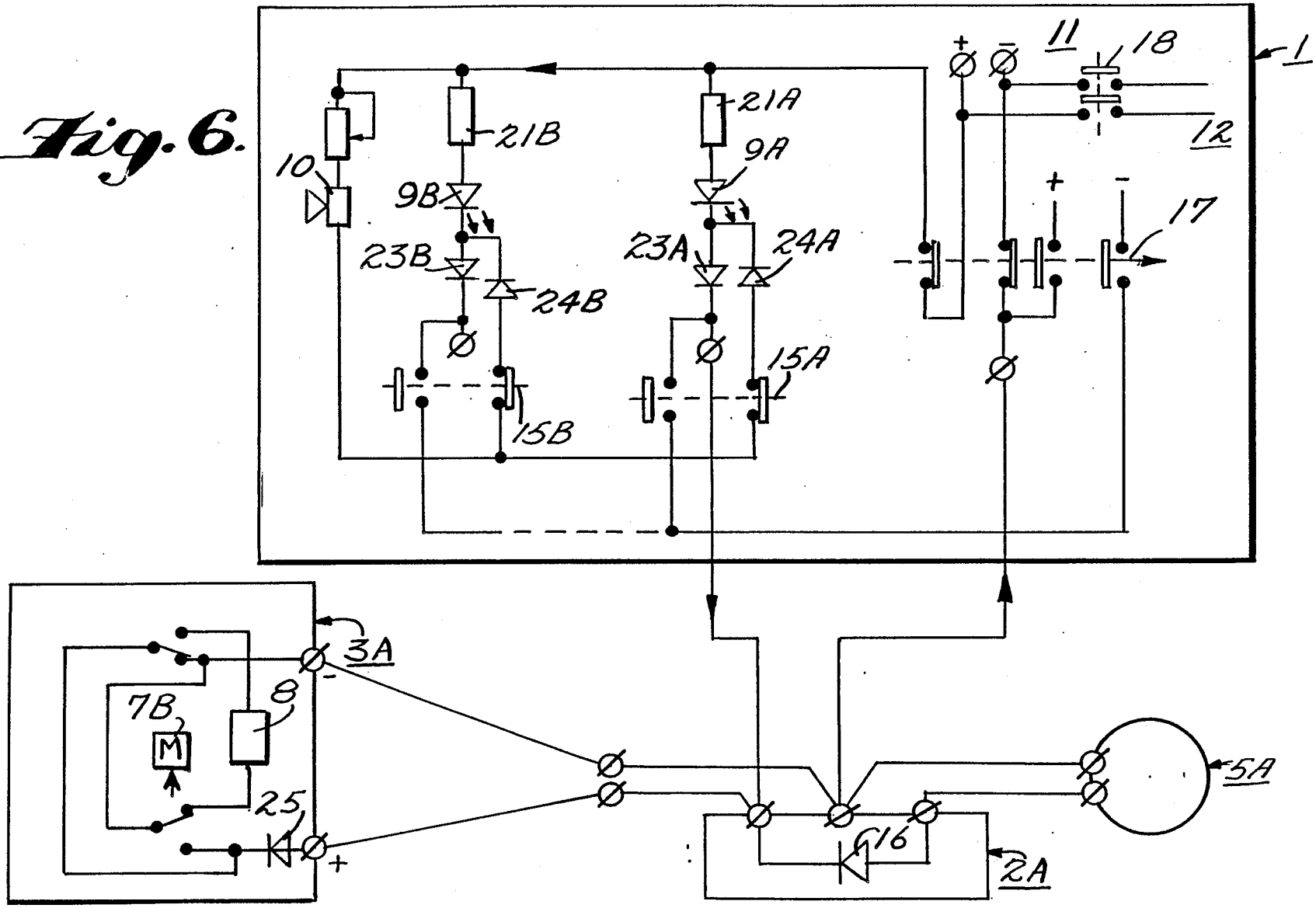
FIG. 6 is a wiring diagram for an installation when triggered
Figure 7:
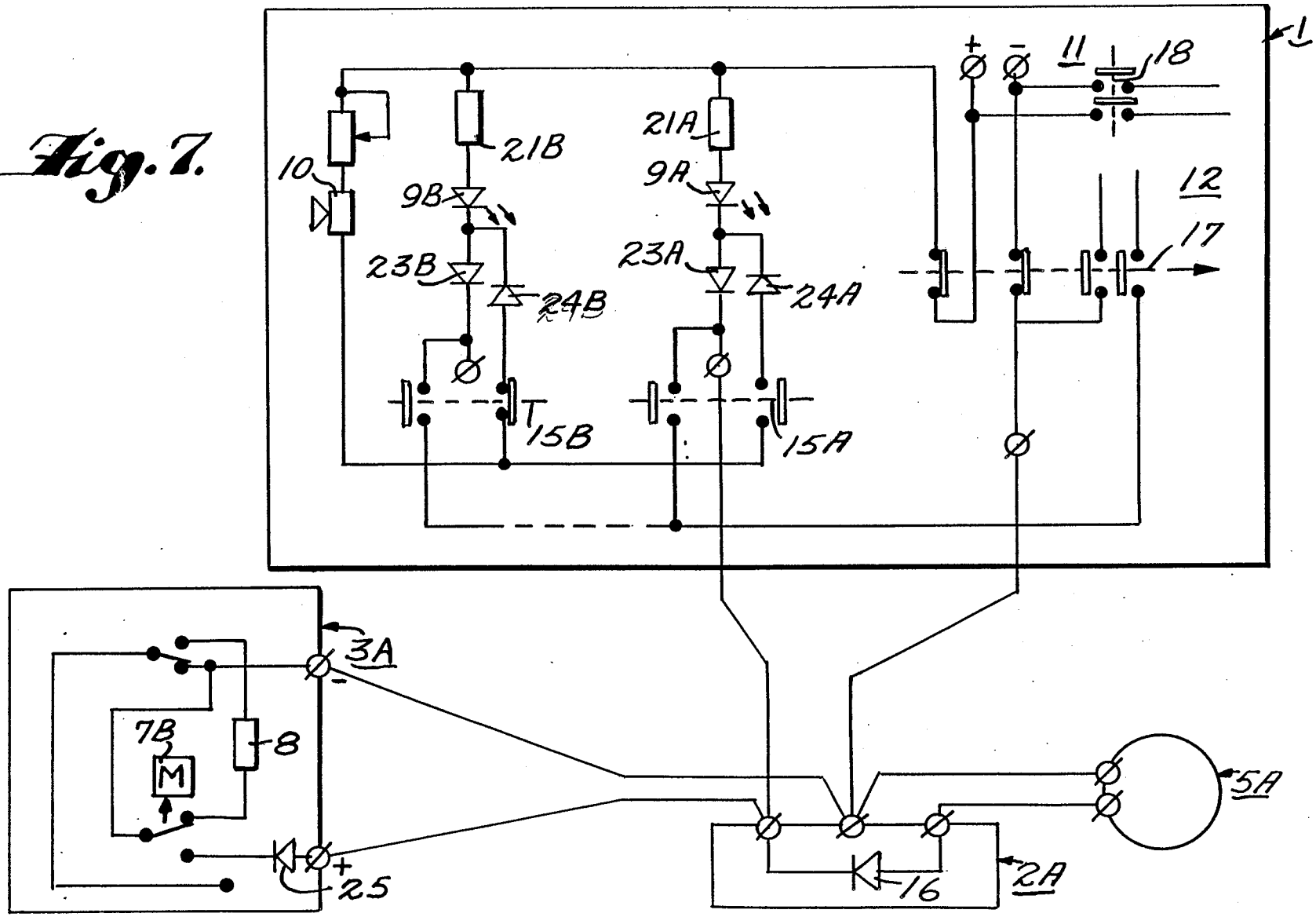
FIG. 7 is a wiring diagram for an installation when triggered but with the buzzer disconnected.
Figure 8:
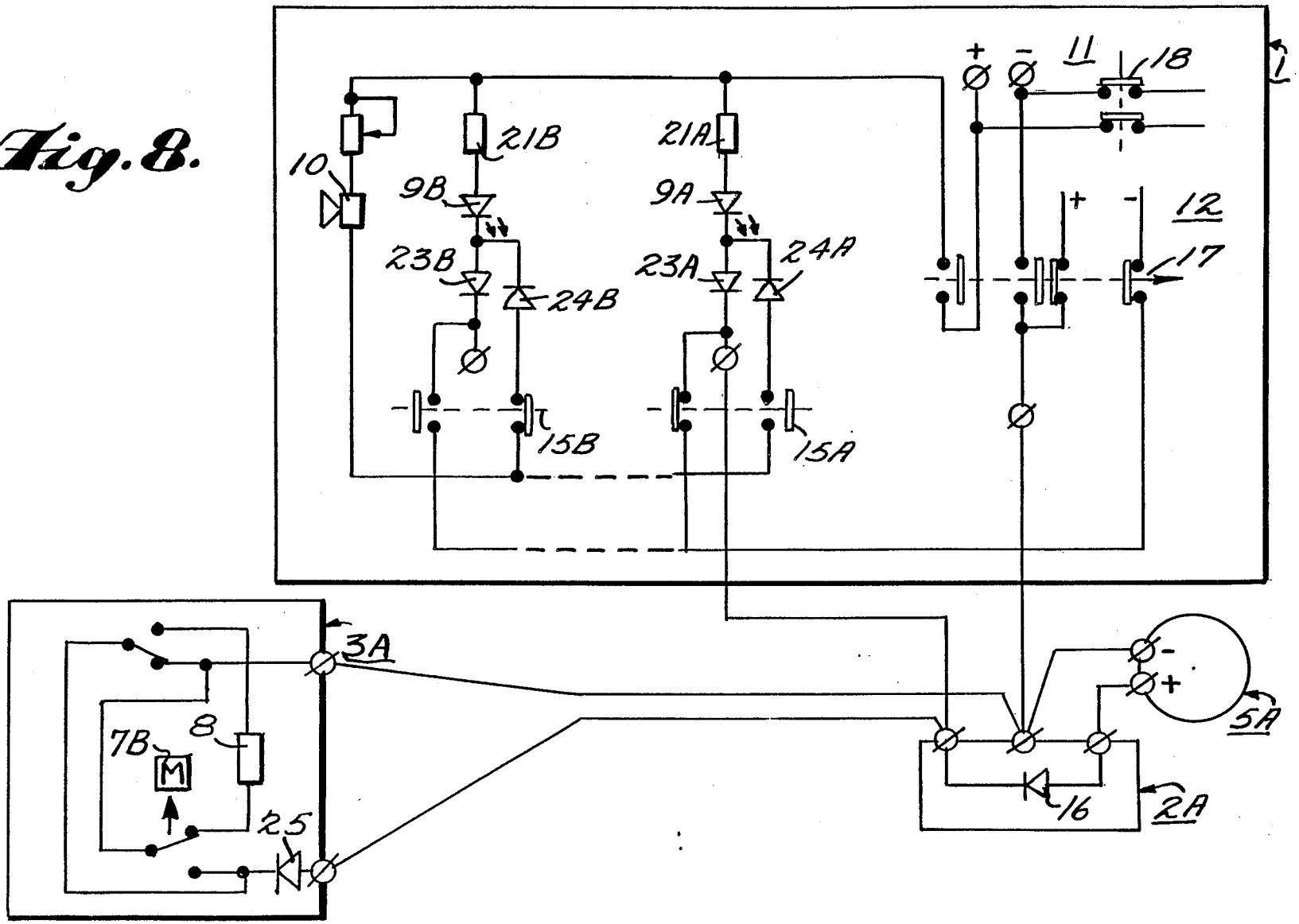
FIG. 8 is a wiring diagram for an installation with an action member connected and FIG. 9 is a block diagram of a complete installation.

The figures show a central alarm and control unit 1 connected to a distribution unit 2A to which are connected a sensing means 3A and an action member 5A. FIG. 5 shows a situation in which current is supplied from a voltage source 11, this being of any size. However, it is probably advisable for this source to supply low voltage. A three-way switch 15A is in the position shown in the figure. A faint lamp in the form of a light-emitting diode 9 indicates if the sensing member 3A is correctly connected. Should a person tread on the cord or net connected to the magnet 7A, this magnet will be dislodged from the sensing means, whereupon the switch will assume the position shown in FIG. 6. This Figure shows clearly that removal of the magnet has caused the resistor 8 to shortcircuit so that the light-emitting diode receives higher voltage and shines more brightly. An operator in the alarm and control centre can immediately see that someone is in the vicinity of the sensing means 3A. At the same time as the light-emitting diode is caused to shine more brightly, a buzzer 10 or some other means generating sound is also activated. If the three-way switch 15A is placed in its intermediate position (FIG. 7) the buzzer 10 will be disconnected. The installation is now ready to initiate the action member 5A. If the action member 5A is to be initiated the three-way switch 15A must be brought to the position shown in FIG. 8. The switch 17 must then be brought to its righthand position so that the distribution unit 2A is supplied with direct voltage from the source 12 where the direct voltage is pole-inverted in relation to the direct voltage supplied earlier. The existence of rectifiers 16 and 25 ensures that the pole-inverted direct voltage will be supplied only to the action member 5A. The action member 5A may consist of a compact little unit containing tape-recorder and loud-speaker. Alternatively, the action member may consist of a searchlight or any other suitable means, or it may even consist of a unit emitting a smoke screen or toxic gases. A water spray could also be initiated in this way. It is also feasible to connect a number of sensing means in series or in parallel. The same applies to the action members which may be connected in parallel or in series. A combination of both series and parallel connection is also possible.

Initiation of the action members can also be performed automatically without manual intervention. The advantage of manual intervention is that undesired initiation of the action members can be prevented.

After initiation of an action member, all switches are moved to the positions shown in FIG. 5 and dislodged magnets are returned to their pockets.

It should be evident that each sensing means may be provided with more than two magnets. Furthermore, each magnet may be connected to one or more cords or one or more nets.

Figure 9:
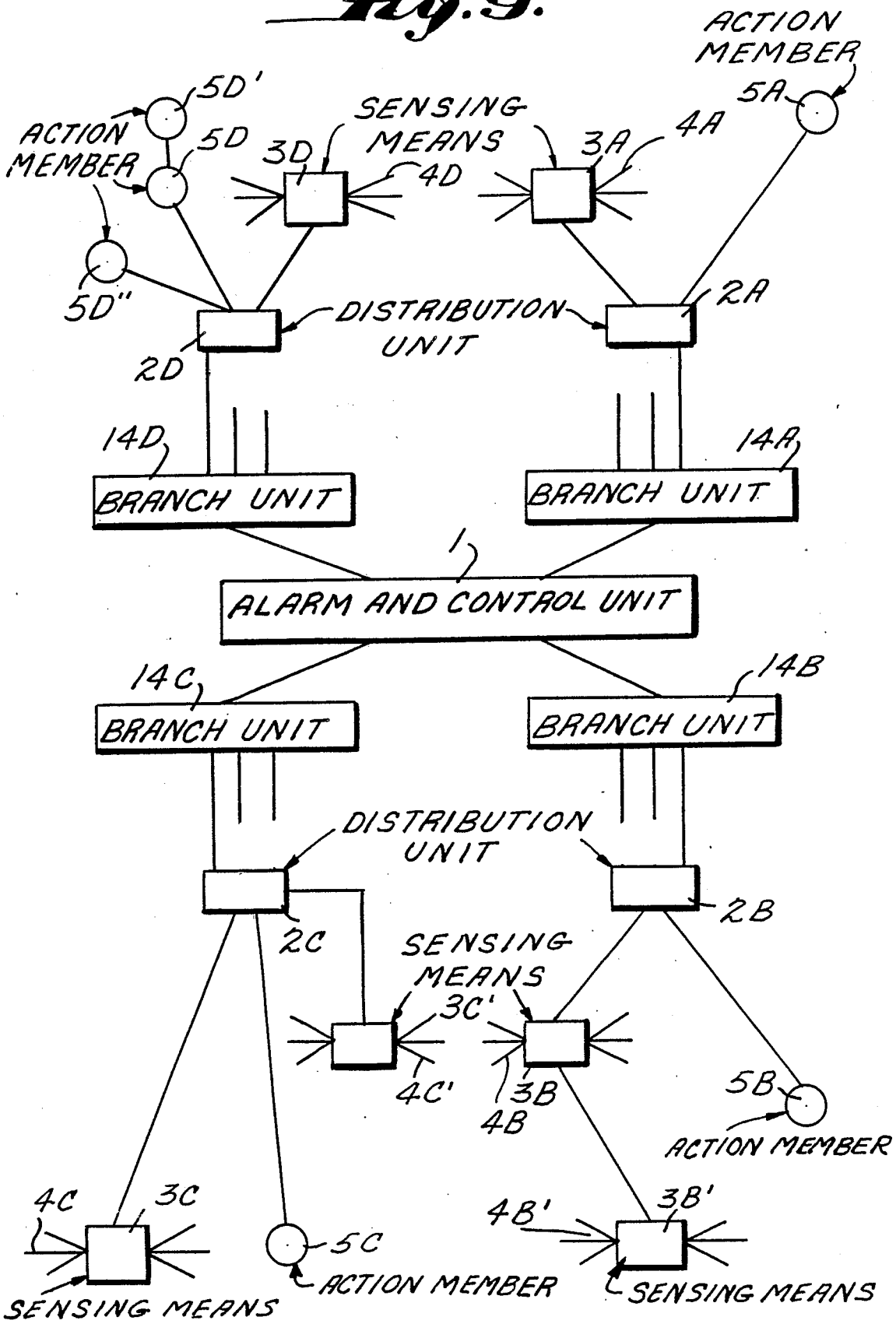

FIG. 9 shows an example of how an area is screened off with the aid of a number of sensing means. Four cables lead from the alarm and control unit 1 to four branch units 14A, 14B, 14C and 14D. Distribution units are connected to each branch unit. Two-way wiring cables lead to each distribution unit, each cable to a branch unit thus containing a number of wires corresponding to the number of distribution units plus one extra. In the top righthand corner of FIG. 9 is a distribution unit 2A to which a sensing means 3A is connected via a sensitive member 4A. In the lower righthand corner are two sensing means, designated 3B and 3B', which are series-connected. The sensing means 3B is provided with a sensitive member 4B and the sensing means 3B' with a sensitive member 4B'. The lower lefthand corner of the figure shows a distribution unit 2C to which are connected two sensing members 3C and 3C'. The upper lefthand corner of FIG. 9 shows that the action members 5 can be both series and parallel-connected, two series-connected action members 5D and 5D' and one parallel-connected action member 5D'' being shown.

The concept of activating two different members by means of different, pole-inverted direct voltages, used for the sensing means and action member, respectively, is generally applicable and can be utilized in other installations where two different members are to be actuated using only direct voltage.

The sensing means utilized in the present invention can be used in installations where mechanical interference is to effect an alteration in a current circuit.

In the foregoing there has been described a sensing means 3, which causes an indication at a mechanical damage to wires, cords, net and the like. The indication is caused by the sensing means allowing a higher value of the current to pass through the same after a damage, said change in current can also be obtained by other than mechanical means. Thus the means can consist of microphones which feel vibrations in the ground or sound appearing at the sensing means 3. It is also possible that the supply means of the sensing means can be reacted by light of different frequences. The supply means can emit light and receive light.

The control unit can have control units, which at change in current value at a sensing means immediately connect the higher voltage, which release the action means. In last mentioned case it ought to be suitable to use a relay which at increasing current from the sensing means attract the relay so that the higher D.C. voltage is supplied to the action member 5.

I claim:

1. An intrusion detection system for protecting an area of ground at ground level, a central monitoring and control unit, a plurality of distribution units placed at selected locations in said area of ground to be protected, said distribution units being wired in circuit relationship with said central monitoring and control unit, a plurality of sensing means wired in circuit relationship with said distribution units, each sensing means comprising an electric switch in said circuit relationship, a movable magnetic operator for said switch, said switch being in a first switching position when said movable magnetic operator is in close proximity thereto, said switch moving to a second switching position when released by moving said magnetic operator away from said switch, an elongated strand means connected to said magnetic operator and inconspicuously deployed over a portion of said area of ground, said elongated strand means connected to said magnetic operator and inconspicuously deployed over a portion of said area of ground comprises a net, said strand means being tripped by movement of an intruder to pull said magnetic operator away from said switch to generate an alarm signal when said switch moves from said first position to said second position, and a low voltage direct current supply in said control unit for supplying direct current operating power for said intrusion detecting system.

2. The intrusion detection system of claim 1 wherein said elongated strand means connected to the magnetic operator of each sensing means being collectively arranged around the perimeter of the area of ground to be protected.

3. The intrusion detection system of claim 1 comprising a two-wire series hookup between the central monitoring and control unit and each individual distribution unit and its connected sensing means and further comprising a light emitting circuit element and three-way switch mounted in said monitoring and control unit in series between said low voltage supply and each respective distribution unit.

4. The intrusion detection system of claim 3 wherein the central monitoring and control unit includes a plurality of parallel connected light emitting circuit elements and three-way switches to feed a plurality of distribution units.

5. The intrusion detection system of claim 3 wherein said sensing means includes a voltage dropping resistor in series circuit with said light emitting circuit element and said three-way switch when said sensing means switch is in said first position whereby said light emitting circuit element emits a light of reduced intensity indicating circuit integrity.

6. The intrusion detection system of claim 5 wherein said voltage dropping resistor is bypassed when said sensing means switch is moved to said second position whereby said light emitting circuit element emits a light of greater intensity indicating the presence of an intruder.

7. The intrusion detection system of claim 6 wherein said sensing means includes a rectifier in series circuit with said light emitting circuit element and three-way switch permitting current flow in one direction only.

8. The intrusion detection system of claim 7, wherein said sensing means includes a plurality of sensing means connected to each other in series.

9. The intrusion detection system of claim 5 wherein said light emitting circuit element comprises a light emitting diode.

10. The intrusion detection system of claim 6 wherein an audible signal means is wired in parallel with said light emitting circuit element to yield an audible signal when said light emitting circuit element is in said greater light intensity state.

11. The intrusion detection system of claim 10 wherein operation of said audible signal means can be terminated by operating said three-way switch to an audible signal means open circuit position.

12. The intrusion detection system of claim 3 including an intruder warning signal means electrically connected to said two-wire series hookup at said distribution unit.

13. The intrusion detection system of claim 12 wherein said electrical connection at said distribution unit includes a first, a second and a third terminal, said first terminal being connected to said central monitoring and control unit, said second terminal being connected to said low voltage direct current supply, said first and second terminals also being connected to said sensing unit, said second and third terminals being connected to said intruder warning signal means, and said first and third terminals being connected by means of a rectifier.

14. The intrusion detection system of claim 12 including means for electrically isolating said intruder warning signal means in said two-wire hookup by reversing the polarity of said low voltage direct current supply with respect to the polarity of the intruder sensing mode operation, so that said rectifiers block any reverse current flow in said distribution unit and said sensing means.

15. The intrusion detection system of claim 14 wherein polarity reversing is effected by relay and switching means including a polarity reversing position of said three-way switch in said monitoring and control unit.

16. The intrusion detection system of claim 15 including a plurality of series connected intruder warning signal means.

17. In an intrusion detection system for protecting an area of ground at ground level, a sensing means for detecting the presence of an intruder, said sensing means comprising a housing having at least two opposed open ended compartments, a magnet slidably arranged for movement in and out of at least one of said compartments, a magnetically operated switch located below said compartment, said switch being responsive to the presence of said magnet in close proximity thereto maintain a first switching position, an elongated strand means connected to said magnet and inconspicuously deployed over a portion of said area of ground, said strand means being tripped by movement of an intruder to pull said magnet out of said compartment thereby enabling said switch to move to a second switching position.

18. The intrusion detection system of claim 17 wherein said magnetically operated switch comprises a glass sealed reed switch.

* * * * *